US010737523B2

(12) United States Patent
Kim

(10) Patent No.: US 10,737,523 B2
(45) Date of Patent: Aug. 11, 2020

(54) STAPLER

(71) Applicant: Jun Gu Kim, Seoul (KR)

(72) Inventor: Jun Gu Kim, Seoul (KR)

( * ) Notice: Subject to any disclaimer, the term of this patent is extended or adjusted under 35 U.S.C. 154(b) by 348 days.

(21) Appl. No.: 15/342,142

(22) Filed: Nov. 3, 2016

(65) Prior Publication Data

US 2018/0015767 A1 Jan. 18, 2018

(30) Foreign Application Priority Data

Jul. 12, 2016 (KR) ..... 10-2016-0088243

(51) Int. Cl.

| | |
|---|---|
| ***D05B 81/00*** | (2006.01) |
| ***B42B 2/04*** | (2006.01) |
| ***B25C 5/06*** | (2006.01) |
| ***B25C 5/11*** | (2006.01) |

(52) U.S. Cl.

CPC ..... *B42B 2/04* (2013.01); *B25C 5/06* (2013.01); *B25C 5/11* (2013.01)

(58) Field of Classification Search

CPC ..... B25C 5/0242; B25C 5/0292; B25C 5/06; B25C 5/11; B42B 2/025; B42B 2/04; D05B 97/12; D05B 97/02; D05B 1/02; D05B 81/00

USPC ..... 227/71; 112/169

See application file for complete search history.

(56) References Cited

U.S. PATENT DOCUMENTS

| | | | | |
|---|---|---|---|---|
| 2,434,133 A * | 1/1948 | Volk | A61B 17/04 | 112/169 |
| 2,479,017 A * | 8/1949 | Merson | D05B 81/00 | 112/169 |
| 2,507,814 A * | 5/1950 | Rantanen | D05B 81/00 | 112/169 |
| 2,639,683 A * | 5/1953 | Huntington | D05B 81/00 | 112/169 |
| 4,463,695 A * | 8/1984 | Killinger | D05B 81/00 | 112/112 |
| 4,497,268 A * | 2/1985 | Killinger | D05B 27/04 | 112/169 |
| 4,501,211 A * | 2/1985 | Seyama | D05B 81/00 | 112/169 |
| 4,522,135 A * | 6/1985 | Ketterer | D05B 57/02 | 112/169 |

FOREIGN PATENT DOCUMENTS

KR 10-0171481 10/1998

* cited by examiner

*Primary Examiner* — Andrew M Tecco
(74) *Attorney, Agent, or Firm* — Jake K. Lee

(57) ABSTRACT

Disclosed is a stapler including: a body including a fixed plate provided on a top portion of one end thereof and formed with a needle insertion hole, and a lower thread supplier provided below the fixed plate to feed a lower thread through the needle insertion hole; and a presser which is connected to the other end of the body at one end thereof by a rotating shaft, includes a fastening needle installed to the other end to stitch an object, and penetrates the needle insertion hole together with an upper thread, in which the object is stitched with the upper thread and the lower thread when pressure is applied to the presser. Since the sheets of paper are bound with the thread, it is possible to prevent the paper from being discolored or crumbed.

3 Claims, 4 Drawing Sheets

STAPLER

CROSS-REFERENCE TO RELATED APPLICATIONS

Pursuant to 35 U.S.C. § 119, this application claims the benefit of priority to Korean Patent Application No. 10-2016-0088243 filed on Jul. 12, 2016 in the Korean Intellectual Property Office, the entire contents of which are hereby incorporated by reference.

TECHNICAL FIELD

The present invention relates to a stapler, and more specifically, to a stapler capable of binding sheets of paper by threads to preserve the paper for a long time.

BACKGROUND

A stapler is a device that binds sheets of paper by driving a staple.

The first stapler was made by use of a principle of a machine gun in the $19^{th}$ century in Connecticut, United States.

Staples used for the stapler are usually made of iron or steel. Alternatively, the staple may be made of copper and various staples, such as colored ones, are commercially available recently.

A process of fabricating the staple is as follows. First, an iron wire is electroplated for the purpose of corrosion proof and the iron wire is then extracted and cut to have a certain size and shape. The iron wires are adhered to each other by means of an adhesive material, and then pressed and bent to form a long strip of staple.

After such a stapler was invented and supplied in the early 1900s, the stapler was used to bind relatively thin books or papers. The bookbinding using the stapler is widely utilized for magazines or newspapers at present.

In the case of books which are bound by the stapler in homes, offices, schools and libraries, paper is discolored into brown, and is disintegrated into a pile of fragments and dust around the staple. If the symptoms continue or get worse, the holes, through which the legs of the staple pass, become wider, such that the staple no longer plays a role of binding the book. In particular, the symptoms occur in the books published in the early 1900s. Even though the symptoms are different depending upon a keeping method and a degree of corrosion, a discoloring range of the paper is gradually enlarged, or the paper is gradually disintegrated into a pile of fragments and dust around the staple.

Some studies analyzed the causes of the symptoms and researches on the damage of paper caused by iron ions have been conducted. The oxidation of iron ions contained in liquid ink has been studied, which is referred to as iron ink gall. This is caused by the difference between particles of the paper and the staple and the interface between the staple and the paper is discolored into brown. The discolored paper is crushed since a length of the paper is shortened.

Meanwhile, when it is necessary for the staple to be removed, the staple can be removed by a staple remover or by hands. However, since the staple is made of iron or steel, it may not be easy to remove the staple despite using the stapler remover. In addition, in the case of removing the staple by hands, nail may be broken or damaged.

SUMMARY OF THE INVENTION

Therefore, the present invention has been made in view of the above problems, and an object of the present invention is to provide a stapler capable of binding paper by threads having a physical property similar to the paper so as to keep document for a long time and also prevent the paper from being discolored or a user from being injured.

In order to achieve the above object, there is provided a stapler including: a body including a fixed plate provided on a top portion of one end thereof and formed with a needle insertion hole, and a lower thread supplier provided below the fixed plate to feed a lower thread through the needle insertion hole; and a presser which is connected to the other end of the body at one end thereof by a rotating shaft, and includes a fastening needle installed to the other end to stitch an object and penetrating the needle insertion hole together with an upper thread, in which the object is stitched with the upper thread and the lower thread when pressure is applied to the presser.

The lower thread supplier has the lower thread, a bobbin and a thread spool, and is configured to be rotated corresponding to operation of the presser so that the object is stitched with the upper thread and the lower thread.

The fastening needle is at least one.

The fastening needle is positioned in a direction perpendicular to a longitudinal direction of the stapler or in a direction parallel with the longitudinal direction.

A resilient member is interposed between the body and the presser to create a restoring force when the pressure is released.

The presser further includes a pressing rod connected to the rotating shaft to press a top surface of the presser, and a second spring to resiliently press the pressing rod.

The presser further includes a thread take-up lever to hold the upper thread, an auxiliary thread take-up lever to adjust tension of the upper thread, and a needle adjuster to adjust the fastening needle, which are positioned between the fastening needle and a spool wound with the upper thread. The presser further includes a needle cover to adjust a height of the needle and attach or detach the needle.

With the above configuration, since the sheets of paper are bound with the thread, it is possible to prevent the paper from being discolored or crumbed.

Also, there is no cumbersome or danger to be caused by removing a staple.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF THE PREFERRED EMBODIMENT

Figure 1:
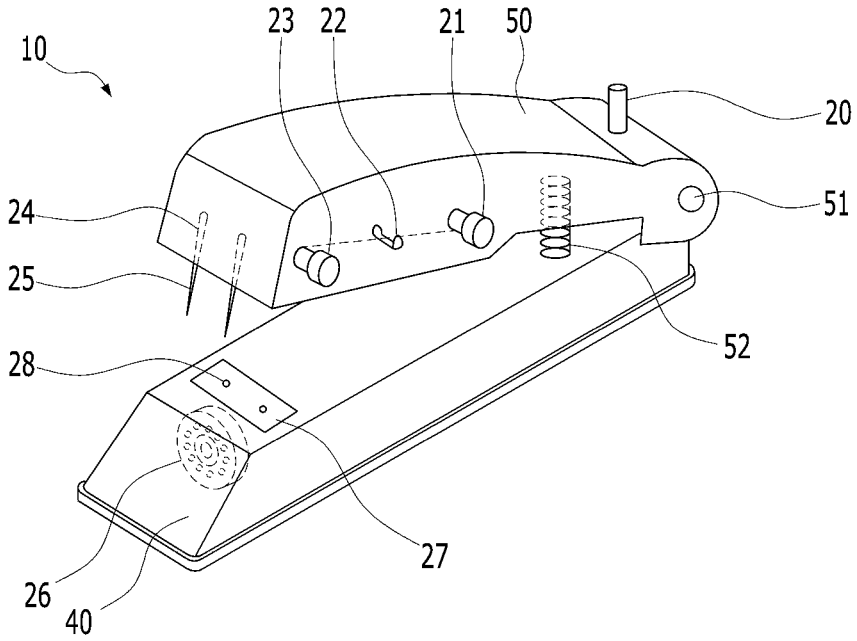
FIG. 1 is a perspective view of a stapler according to one embodiment of the present invention.

A preferred embodiment of the present invention will now be described in detail with reference to the accompanying drawings, in which like parts are shown by corresponding reference numerals.

Throughout the description and claims, the word 'comprise' means that at least all of the listed elements must exist but other elements that are not mentioned in the claim may also be present.

Figure 2:
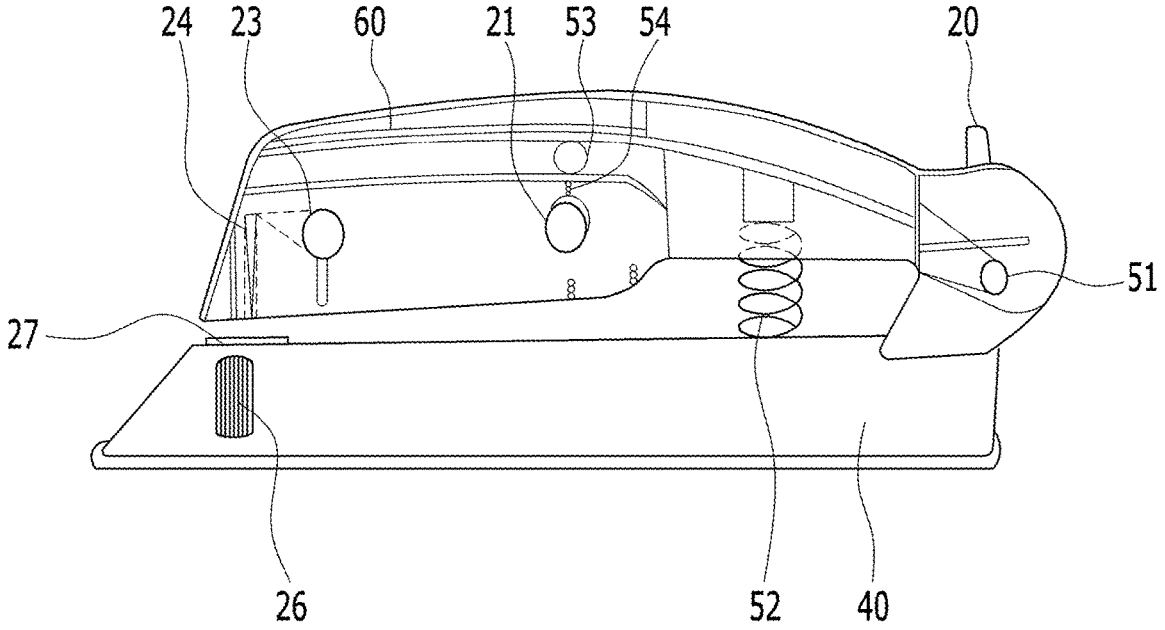
FIG. 2 is a side view of the stapler according to the embodiment of the present invention.
Figure 3:
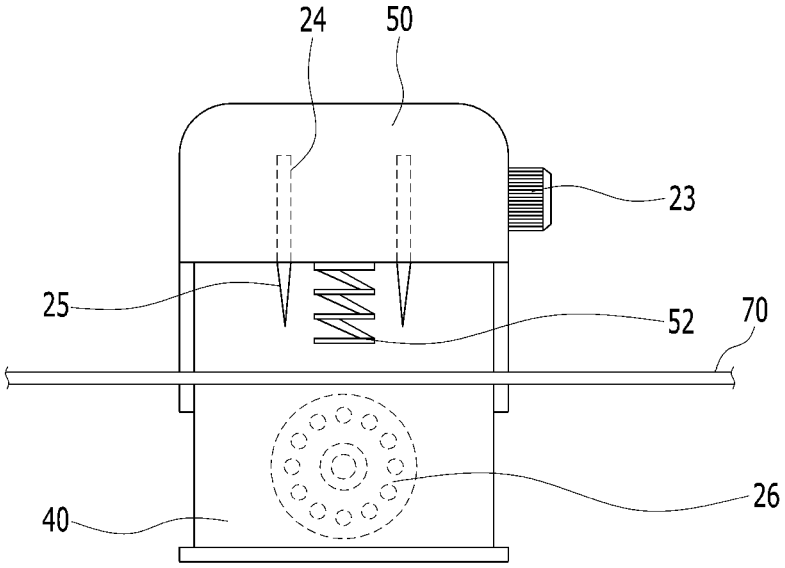
FIG. 3 is a front view of the stapler according to the embodiment of the present invention.
Figure 4:
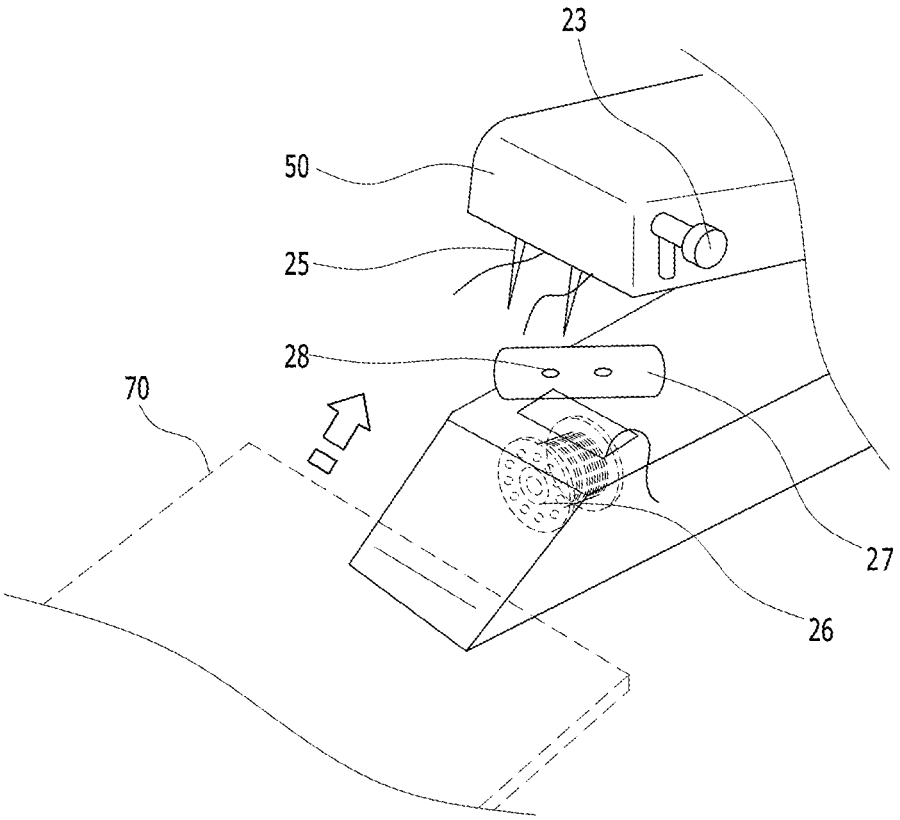
FIG. 4 is a view illustrating an application of the stapler according to the embodiment of the present invention.

FIG. 1 is a perspective view of a stapler according to one embodiment of the present invention. FIG. 2 is a side view of the stapler according to the embodiment of the present invention. FIG. 3 is a front view of the stapler according to the embodiment of the present invention. FIG. 4 is a view illustrating an application of the stapler according to the embodiment of the present invention.

Referring to FIGS. 1 to 3, a body 40 is a base for pinching sheets of paper to be bound, and serves as a base of a stapler 10.

The body 40 may be formed in various shapes, such as a rectangle, an oval or the like, in view of application or design thereof.

The body 40 and a presser 50 are preferably made of any one of a synthetic material, a metal, such as aluminum or steel, and a composite material which is not deformed when the body 40 and the presser 50 operate. The stapler 10 capable of binding sheets of paper by threads according to the present invention can be made to have a certain size, depending upon a binding shape of paper.

The body 40 is provided with a fixed plate 27 on a top portion thereof, and the fixing plate 27 is formed with needle insertion holes 28 through which a lower thread passes. The fixed plate 27 is installed at a position opposite to fastening needles 25 which are provided on an upper portion of the presser 50. The fixed plate 27 can be connected to an upper portion of the body 40 to adjust a height of the fixed plate.

The body 40 is equipped with a lower thread supplier 26. The lower thread supplier 26 automatically supplies the lower thread according to a progress of binding the paper by sewing, and fastens the lower thread and an upper thread to make a knot so that the lower thread and the upper thread are not released by pulling an end of the thread. To this end, the lower thread supplier 26 has the lower thread, a bobbin and a thread spool. The lower thread supplier 26 is a common part used for a sewing machine, and thus its detailed description will be omitted herein (see FIG. 3 shown and described in Korean Patent No. 10-0928103).

The body 40 and the presser 50 are connected to each other by a rotating shaft 51. The presser 50 is not separated from the body 40 by the rotating shaft 51, and can rotate around the rotating shaft 51. The rotating shaft 50 adjusts an angle defined between the body 40 and the presser 50, and rotatably supports the presser 50.

The presser 50 is a member which is pressed by a user. To this end, the presser 50 has the fastening needles 25, and can rotate at a predetermined angle by the rotating shaft 51. The presser 50 is returned to its original position by a resilient member 52 after the pressure applied by the user is released. The resilient member 52 is preferably installed to the rotating shaft 51, in which the body 40 is connected to the presser 50 by the rotating shaft 51. The portion of connecting the body 40 and the presser 50 serves as a contact point of the resilient member 52. The resilient member 52 is applied by the pressure when the user applies the pressure to the presser 50. The resilient member 52 is automatically returned to its original position by a compressive force stored in a spring when the pressure is released from the presser 50.

The resilient member 52 is positioned on a top surface of the body 40, and is connected to a bottom surface of the presser 50, so that the presser 50 is automatically moved to its original position by the resilient force when the pressure is released.

The fastening needles 25 are installed to the presser 50. If the user applies the pressure to the presser 50, the fastening needles 25 penetrate the sheets of paper and the needle insertion holes 28 to stich the paper with the lower thread and the upper thread. After that the fastening needles 25 go out from the paper. The application of the pressure can be executed once, or can be repeated several times. If the pressing position is changed while the application of the pressure is repeating several times, a seam line can be formed. The seam line is formed on the bottom surface of the paper due to the lower thread, and is also formed on the top surface of the paper due to the upper thread inserted in the fastening needle 25. The process of forming the seam line is disclosed in Korean Utility Model No. 20-1991-0005471, Korean Patent No. 10-0816565 and Korean Laid-Open Patent No. 10-2013-0039427.

The fastening needle 25 can include a needle for a common portable sewing machine, in addition to a screw-type needle, and it is possible to easily adjust a height of two or more needles and to easily attach or detach the needle.

At least one fastening needle 25 can be provided, and this embodiment shows and explains the configuration of two fastening needles 25. The object of the present invention can be achieved by only one fastening needle 25. Also, although FIGS. 1 to 4 show the configuration having one lower thread supplier 26, two lower thread suppliers 26 corresponding to the respective fastening needles 25 may be provided. In this instance, the lower thread supplier 26 rotates corresponding to the operation of the presser 50 so as to stich the paper with the upper thread and the lower thread. The lower thread supplier 26 may be rotated by a mechanical mechanism or an electric motor. Two fastening needles 25 can be positioned in a direction perpendicular to a longitudinal direction of the stapler 10 or in a direction parallel with the longitudinal direction.

The presser 50 has a pressing rod 53 for pressing the top surface of the presser 50, and a second spring 54 for resiliently pressing the pressing rod 53.

If the binding of the paper is completed and the pressure applied to the presser 50 is released, the presser 50 is returned to its original position by a restoring force of the second spring 54, as well as the restoring force of the resilient member 52, and stands by a next operation.

A pressing member 60 extends from the upper portion of the presser 50 to a rear end in a curved shape, and is connected to the rotating shaft 51. A certain portion of the pressing member 60 is connected to the resilient member 52 to increase the pressure.

The upper end of the presser 50 is provided with a spool pin 20, and this embodiment shows the spool pin protruding from the upper end. Of course, the spool pin 20 may be installed to a side of the presser 50 or an inside of the presser. Alternatively, two spool pins may be installed to both sides thereof. The spool pin 20 receives the spool wound with the upper thread, and the upper thread wound around the spool extends to the fastening needle 25 through a thread take-up lever 21, an auxiliary thread take-up lever 22 and a needle adjuster 23. The stapler may further include a needle cover 24 for concealing the fastening needle 25. The needle cover 24 is configured to allow the fastening needle to protrude, so that the needle cover can adjust the height of the needle, as well as covering the needle. That is, the fastening needle 25 can be replaced by the needle cover 24, as well as adjusting the height of the needle. If necessary, the fastening needle 25 can be detached from the presser 50.

FIG. 4 is a view illustrating the application of the stapler according to the embodiment of the present invention.

Referring to FIG. 4, the upper thread for stitching the paper with the lower thread through the presser 50 is fed from the spool supported by the spool pin 20, and then is sewn by the fastening needle 25. The upper thread is guided by the thread take-up lever 21 and the auxiliary thread take-up lever 22 which are installed to the presser 50, without being entangled.

As described above, the stapler according to the present invention binds the sheets of paper by the threads having the physical properties similar to the paper, thereby keeping the paper 70 for a long time and reducing the discoloration or the damage. That is, the body 40 equipped with the lower supplier 26 and the fixed plate 27 cooperates with the presser 50 provided with the fastening needle 25 which is connected to the upper thread, which carries out the stapling function of the common stapler by the thread through the sewing function of the sewing machine. The lower thread supplier 26 automatically supplies the lower thread as the sewing function is in progress through the stapler 10, and then is locked with the upper thread fed through the presser 50, which makes the knot so that the lower thread and the upper thread are not released by pulling the end of the thread.

With the stapler 10 according to the present invention, anyone can easily bind the paper, regardless of the material or size of the paper, and students or people can carry the stapler without difficult. As well as binding the paper, it is possible to repair a hem of a dress anywhere and at any time since it can be easily carried.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A stapler comprising:

a body including a fixed plate provided on a top portion of one end thereof and formed with a needle insertion hole, and a lower thread supplier provided below the fixed plate to feed a lower thread through the needle insertion hole; and a presser connected to another end of the body at an end thereof through a rotating shaft, and including a fastening needle installed at another end thereof to stitch an object, the fastening needle penetrating the needle insertion hole together with an upper thread, wherein a resilient member is interposed between the body and the presser to create a restoring force when the pressure is released, wherein the stapler includes two fastening needles and two lower thread suppliers, wherein the fastening needles form a one-to-one correspondence with the lower thread suppliers, wherein the presser is formed with a pressing rod for pressing a top surface of the presser and a pressing member extending from an upper portion of the presser to a rear end in a curved shape so as to be connected to the rotating shaft, the pressing member connected to the resilient member, wherein two spool pins are installed in the presser, the two spool pins each receiving a spool wound with the upper thread, wherein a thread take-up lever to hold the upper thread, an auxiliary thread take-up lever to adjust tension of the upper thread, and a needle adjuster to adjust the fastening needle are each formed between the fastening needle and the spool, wherein the presser further includes a needle cover to adjust a height of the needle, wherein the lower thread suppliers are configured to rotate corresponding to operation of the presser so that the object is stitched with the upper thread and the lower thread, and wherein a seam line is formed when a pressing position is changed.

2. The stapler according to claim 1, wherein the fastening needle is positioned in a direction perpendicular to a longitudinal direction of the stapler or in a direction parallel with the longitudinal direction.

3. The stapler according to claim 1, further comprising a second spring disposed at a lower portion of the pressing rod to resiliently press.

* * * * *